US008337747B2

(12) United States Patent
Imazato et al.

(10) Patent No.: US 8,337,747 B2
(45) **Date of Patent: *Dec. 25, 2012**

(54) PROCESS FOR MANUFACTURING COMPOSITE SINTERED MACHINE COMPONENTS

(75) Inventors: Hiromasa Imazato, Matsudo (JP); Koichiro Yokoyama, Matsudo (JP)

(73) Assignee: Hitachi Powdered Metals Co., Ltd., Matsudo-Shi (JP)

( * ) Notice: Subject to any disclaimer, the term of this patent is extended or adjusted under 35 U.S.C. 154(b) by 73 days.

This patent is subject to a terminal disclaimer.

(21) Appl. No.: 13/045,910

(22) Filed: Mar. 11, 2011

(65) Prior Publication Data

US 2011/0158842 A1 Jun. 30, 2011

Related U.S. Application Data

(63) Continuation of application No. 11/979,323, filed on Nov. 1, 2007, now Pat. No. 7,947,219.

(30) Foreign Application Priority Data

Nov. 10, 2006 (JP) ..... 2006-305070

(51) Int. Cl.
*B22F 7/00* (2006.01)
*F16H 57/08* (2006.01)

(52) U.S. Cl. ..... 419/5; 419/38; 419/8; 29/428; 475/331

(58) Field of Classification Search ..... 419/5
See application file for complete search history.

(56) References Cited

U.S. PATENT DOCUMENTS

| | | | |
|---|---|---|---|
| 4,503,009 | A | 3/1985 | Asaka |
| 4,539,197 | A | 9/1985 | Asaka et al. |
| 6,120,727 | A | 9/2000 | Asaka et al. |
| 2007/0216254 | A1 | 9/2007 | Farnia et al. |
| 2008/0110334 | A1 | 5/2008 | Mogami |

FOREIGN PATENT DOCUMENTS

| | | |
|---|---|---|
| JP | 58-193304 | 11/1983 |
| JP | A-64-011913 | 1/1989 |
| JP | B-3495264 | 11/2003 |
| JP | B-3833502 | 7/2006 |

*Primary Examiner* — Roy King
*Assistant Examiner* — Christopher Kessler
(74) *Attorney, Agent, or Firm* — Oliff & Berridge PLC

(57) ABSTRACT

In a process for manufacturing composite sintered machine components, the composite sintered machine component has an approximately cylindrical inner member and an approximately disk-shaped outer member, the inner member has pillars arranged in a circumferential direction at equal intervals and a center shaft hole surrounded by the pillars, and the outer member has holes corresponding to the pillars of the inner member and a center shaft hole corresponding to the center shaft hole of the inner member. The process comprises compacting the inner member and the outer member individually using an iron-based alloy powder or an iron-based mixed powder so as to obtain compacts of the inner member and the outer member, tightly fitting the pillars of the inner member into the holes of the outer member, and sintering the inner member and the outer member while maintaining the above condition so as to bond them together.

2 Claims, 5 Drawing Sheets

PROCESS FOR MANUFACTURING COMPOSITE SINTERED MACHINE COMPONENTS

This is a Continuation of application Ser. No. 11/979,323, filed Nov. 1, 2007 (issued as U.S. Pat. No. 7,947,219), which claims foreign priority to Japanese Patent Application No. 2006-305070, filed Nov. 10, 2006. The disclosure of the prior applications is hereby incorporated by reference herein in their entireties.

BACKGROUND OF THE INVENTION

1. Technical Field

The present invention relates to processes for manufacturing machine components such as carriers for a planetary gear system that is included in an automatic transmission of an automobile (hereinafter called a "planetary carrier") by a powdered metallurgical method. Specifically, the present invention relates to a process for manufacturing composite sintered machine components in which a compact (an inner member) having plural pillars and another compact (an outer member) having holes corresponding to the pillars are tightly fitted and are sintered so as to bond each other.

2. Background Art

Although planetary carriers differ in design according to the type of transmission, they usually comprise a cylindrical drum, flanges formed at both ends or at the middle of the drum, and a center shaft hole into which a shaft of a transmission is inserted. Generally, the drum is formed with plural openings for holding planetary gears (not shown in the figure). FIG. 1 shows an example of such a planetary carrier, and each of the plural (in this case, three) openings 11 formed on a drum 10 is rotatably mounted with a planetary gear (not shown in the figure). The planetary gear is engaged with a sun gear of a shaft (not shown in the figure) inserted into a center shaft hole 12 of the drum 10 at the inner side of the drum 10, and it is engaged with a ring gear (not shown in the figure) at the outer side of the drum 10. Flanges 20 and 25 are formed at the upper end and the lower end of the drum 10, and the flange 20 in the upper side of the figure is formed with spur teeth 21 for transmitting a torque. Moreover, a boss 23 is concentrically formed on the upper surface of the upper flange 20, and the boss 23 is formed with a spline 24 for engaging a clutch system (not shown in the figure).

Thus, since a planetary carrier has such a complicated structure, if it is mass-produced by machining process such as cutting, great number of processing steps are required, whereby there are disadvantages in cost and accuracy of shape and size. Therefore, planetary carriers are usually manufactured by a powdered metallurgical method that is suitable for manufacturing products uniformly in large quantities; however, in the case of planetary carriers having openings forming undercuts, which are provided on a drum, it is difficult to form them unitarily in a die.

As a method developed to solve these problems, a required shape is divided into several portions, and after the portions are individually formed and sintered, they are combined to form the required shape. For convenience of explanation, a planetary carrier will be described based on a schematic shape shown in FIG. 2 hereinafter. The planetary carrier shown in FIG. 2 has a simple flange 20 at the upper end and a simple flange 25 at the lower end on a cylindrical drum 10, and it has three openings 11 at equal intervals in the circumferential direction of the drum 10. In the planetary carrier shown in FIG. 1, the spur teeth 21 and the boss 23 of the flange 20 are omitted. In order to form the planetary carrier having such shape by die forming, the planetary carrier is divided into two portions by separating one flange 20 (25) from the drum 10.

Specifically, as shown in FIGS. 3A to 3F, a planetary carrier is divided into a disk-shaped member 30 (corresponding to the flange 20 in FIG. 2) having a center shaft hole 31 and a body member 40, and the disk-shaped member 30 and the body member 40 are individually formed and sintered so as to make two portions. Then, the sintered disk-shaped member 30 and the sintered body member 40 are mated and bonded by brazing at the divided surfaces. FIG. 3A is a top view of the disk-shaped member 30, FIG. 3B is a longitudinal sectional view of the disk-shaped member 30, FIG. 3C is a top view of the body member 40, FIG. 3D is a longitudinal sectional view of the body member 40, FIG. 3E shows a condition in which the disk-shaped member 30 and the body member 40 are bonded, that is, it is a top view showing a condition shown in FIG. 2, and FIG. 3F is a longitudinal sectional view of the condition shown in FIG. 3E. In this case, the drum of the body member 40 has relatively large openings, and the appearance thereof may be described as "three fan-shaped pillars". Therefore, the drum will be called plural (three) pillars 42 hereinafter. That is, the body member 40 has a shape in which a disk-shaped portion 47 having a center shaft hole 41 is integrally fixed to ends of the plural pillars 42.

When the disk-shaped member 30 and the body member 40 are brazed, since a liquid phase is generated at the bonding surface, the centers thereof may not be aligned (the axes thereof may not be aligned), and the phases thereof may be misaligned (they may be misaligned in circumferential direction), whereby the accuracy of the products tends to be decreased. Moreover, the bonding strength of the disk-shaped member 30 and the body member 40 mainly depends on the strength of the brazing metal, whereby it is difficult to obtain the required level of strength.

Methods of improvement have been suggested to deal with the above problems and are disclosed in Japanese Patents Nos. 1427539 corresponding to U.S. Pat. No. 4,503,009 (patent document 1), U.S. Pat. No. 1,781,330 (patent document 2), and U.S. Pat. No. 3,495,264 corresponding to U.S. Pat. No. 6,120,727, GB. Patent No. 2343682, and DE. Patent No. 19944522 (patent document 3). The methods of improvement employ a technique in which a hole provided in one compact is tightly fitted with a pillar portion provided at another compact, and these are sintered so as to bond together. That is, as shown in FIGS. 4A to 4F, a body member 40 is a compact (inner member) in which fan-shaped pillars 42 are integrally formed, and a disk-shaped member 30 is a compact (outer member) in which holes 32 corresponding to the shape of the pillars 42 of the body member 40 are formed in connection with a center shaft hole 31. Then, the body member 40 and the disk-shaped member 30 are sintered in a condition in which the pillars 42 of the body portion 40 are tightly fitted to the holes 32 of the disk-shaped portion 30. In this case, they are sintered in such a way that the amount of thermal expansion of the body member 40 is set to be greater than the amount of thermal expansion of the disk-shaped member 30 in a high temperature range (diffusion temperature range of additive ingredients) in sintering, thereby obtaining a sintered component having a predetermined shape. FIG. 4A is a top view of the disk-shaped member 30, FIG. 4B is a longitudinal sectional view of the disk-shaped member 30, FIG. 4C is a top view of the body member 40, FIG. 4D is a longitudinal sectional view of the body member 40, FIG. 4E is a top view showing a condition in which the pillars 42 of the body member 40 are tightly fitted to the holes 32 of the disk-shaped member 30, and FIG. 4F is a longitudinal sectional view showing the condition shown in FIG. 4E.

In order to produce the above-described condition in which the amount of thermal expansion of the inner member (body member 40) is greater than the amount of thermal expansion of the outer member (disk-shaped member 30) in the high temperature range during sintering, in the patent document 1, carbon is included in an inner member as an essential ingredient at an amount greater than that of an outer member by at least 0.2 mass %. In the patent document 2, an iron powder forms an outer member, and 5 to 10% of the iron powder is made from a carbonyl iron powder. In the patent document 3, a zinc stearate is used as a powdered lubricant only in an inner member, and it is sintered in a carburizing atmosphere so that the amount of the thermal expansion of the inner member is increased.

According to the methods, the above-mentioned misalignments of the centers and the phases do not occur, but the bonding surfaces of the inner member and the outer member tend to be insufficiently bonded each other, and the required level of the bonding strength may not be obtained. The reason for this is described hereinafter. That is, in the case of the above method in which the pillar (which approaches the inner side by tightly fitting) is tightly fitted to the hole (which approaches the outer side by tightly fitting) of a compact, if the contacting surface thereof is a tightly fitted cylindrical surface, and the amount of thermal expansion of the pillar side (inner side) is grater than that of the hole side (outer side), the entire surface of the contacting surface is tightly contacted, whereby the pillar and the hole are bonded by diffusion. On the other hand, in the case of the planetary carrier shown in FIGS. 4A to 4F, the contacting surface of the disk-shaped member 30 and the body member 40, that is, the contacting surface of the pillars 42 and the inner surface of the holes 32 into which the pillars 42 are inserted, is not completely closed, and the contacting surface is open to the center shaft hole 31. Therefore, even though the amount of thermal expansion of the body member 40 is set to be relatively grater than that of the disk-shaped member 30 as in the methods disclosed in the patent documents 1 to 3, pressure due to the expansion of the pillars 42 impinges on the side of the center shaft hole 31, whereby the contacting surface of the disk-shaped member 30 and the body member 40 may not tightly contact, and the bonding strength is decreased.

Furthermore, a method is disclosed in Japanese Patent No. 3833502 (patent document 4). As shown in FIGS. 5A to 5F, both sides 45, which are the sides of the pillars 42 provided to the body member 40 (inner member), are modified so as to have a refractile surface (stepped shape), and the outline of the holes 32 provided to the disk-shaped member 30 (outer member) is modified so as to have a shape corresponding to the sides of the pillars 42 so as to secure the bonding strength. According to that shape, the effect of strain based on the difference of the amount of thermal expansion occurring at the bonding surface of the pillars 42 and the inner surface of the holes 32 during sintering is decreased, and the expansion pressure of the pillars is prevented from escaping to the side of the center shaft hole 31 because the pillars 42 are thin at the bent portion, whereby the bonding strength is secured.

The technique disclosed in the patent document 4 is an elaboration of the technique disclosed in the patent documents 1 to 3, and it is based on a condition in which the amount of thermal expansion of the body member 40 is greater than that of the disk-shaped member 30. In this case, not only the pillars 42, but also the entire body member 40 can expand, and even when the expansion of the pillars 42 is restricted by the holes 32 of the disk-shaped member 30, a deflection may occur because the remaining portion expands, and the degree of parallelization of the disk-shaped member 30 and the body member 40 is thereby lost.

Since the planetary carrier is formed by arranging flanges at both ends of the pillars, if the degree of parallelization is lost in this way, the shape is difficult to correct by applying pressure again. Therefore, deflection that occurred during sintering and bonding will be a disadvantage in manufacturing. Moreover, the disk-shaped member 30 has a thin portion 38 between an outer periphery 37 and the hole 32 of the disk-shaped member 30 shown in FIGS. 4A to 4F and FIGS. 5A to 5F, and the thin portion 38 deforms according to the expansion of the body member 40, especially, the pillars 42, whereby there are disadvantages in which the degree of circularity of the sintered disk-shaped member 30 (in the planetary carrier shown in FIG. 1, the dimensional accuracy of the teeth) is inferior, and fracture may occur at the thin portion 38.

SUMMARY OF THE INVENTION

An object of the present invention is to provide a process for manufacturing composite sintered machine components such as planetary carriers. In the composite sintered machine components, when a compact of an outer member having plural pillars and a compact of an inner member having hole portions corresponding to the pillars of the compact of the outer member are tightly fitted and sintered so as to bond each other, the outer member and the inner member can be bonded with a sufficient bonding strength without utilizing a difference in thermal expansion thereof in a high temperature range during sintering, and deflections of the outer member and the inner member, and deformations and fractures of thin portion of the outer member can be avoided.

The present invention provides a process for manufacturing composite sintered machine components. The composite sintered machine component has an approximately cylindrical inner member having pillars arranged in a circumferential direction at equal intervals and a center shaft hole surrounded by the pillars, and it also has an approximately disk-shaped outer member having holes corresponding to the pillars of the inner member and a center shaft hole which corresponds to the center shaft hole of the inner member and is connected to the holes. The process comprises compacting the inner member and the outer member individually with an iron-based alloy powder or an iron-based mixed powder so as to obtain compacts of the inner member and the outer member, tightly fitting the pillars of the inner member into the holes of the outer member, and sintering the inner member and the outer member and maintaining the above condition so as to bond them together. A circumferential side surface facing the circumferential direction of the pillars of the inner member and a circumferential side surface facing the circumferential direction of the hole of the outer member are interference fitted at 0 to 0.03 mm of interference. A radial side surface facing the radial direction of the pillars of the inner member and a radial side surface facing the radial direction of the hole of the outer member are interference fitted at not more than 0.01 mm of the interference or are through fitted (interference is minus).

In the present invention, specifically, the following may be mentioned as preferred embodiments.

The radial side surface of the pillar of the inner member and the radial side surface of the convex portion of the outer member are tightly fitted at 0 mm of the interference or are through fitted (interference is minus). The circumferential side surface of the pillars of the inner member is formed in a range −30 to 30° with respect to a radial line extending in a radial direction. Moreover, at least one concave portion is formed on the radial side surface of the pillars of the inner member, a convex portion corresponding to the concave portion is formed on the hole of the outer member, and each circumferential side surface of the concave portion and the convex portion facing each other is interference fitted at 0 to 0.03 mm of interference. Furthermore, the inner compact and the outer compact have the same compositions.

According to the present invention, the circumferential side surface of the pillars of the inner member and the circumferential side surface of the hole of the outer member are interference fitted at 0 to 0.03 mm of the interference, and a sufficient bonding strength is thereby obtained. The radial side surface of the pillars and the radial side surface of the hole are interference fitted at not more than 0.01 mm of the interference or are through fitted (interference is minus), whereby a deformation and a fracture of thin portion of the outer member can be avoided. Moreover, the inner member and the outer member can be made from raw powders having the same composition, whereby a step for preparing different raw powders for the inner member and the outer member can be omitted, and an error such as an inappropriate composing of raw powders can be avoided.

BRIEF DESCRIPTION OF DRAWINGS

FIGS. 3A to 3F show a conventional process in which a component shown in FIG. 2 is divided into two portions, and sintered compacts of the portions are bonded by brazing so as to manufacture a component, wherein FIG. 3A is a top view of a disk-shaped member, FIG. 3B is a sectional view taken along line B-B of FIG. 3A, FIG. 3C is a top view of a body member, FIG. 3D is a sectional view taken along line D-D of FIG. 3C, FIG. 3E is a top view of the body member, and FIG. 3F is a sectional view taken along line F-F of FIG. 3E.

FIGS. 4A to 4F show a process in which the component shown in FIG. 2 is divided into two portions, and compacts of the portions are tightly fitted and sintered so as to manufacture a component, wherein FIG. 4A is a top view of a disk-shaped member, FIG. 4B is a sectional view taken along line B-B of FIG. 4A, FIG. 4C is a top view of a body member, FIG. 4D is a sectional view taken along line D-D of FIG. 4C, FIG. 4E is a top view of the body member, and FIG. 4F is a sectional view taken along line F-F of FIG. 4E.

FIGS. 5A to 5F show a conventional process in which the component shown in FIG. 2 is manufactured by tightly fitting and sintering compacts of two portions according to the patent document 4, wherein FIG. 5A is a top view of a disk-shaped member, FIG. 5B is a sectional view taken along line B-B of FIG. 5A, FIG. 5C is a top view of a body member, FIG. 5D is a sectional view taken along line D-D of FIG. 5C, FIG. 5E is a top view of the body member, and FIG. 5F is a sectional view taken along line F-F of FIG. 5E.

PREFERRED EMBODIMENTS OF THE INVENTION

Figure 1:
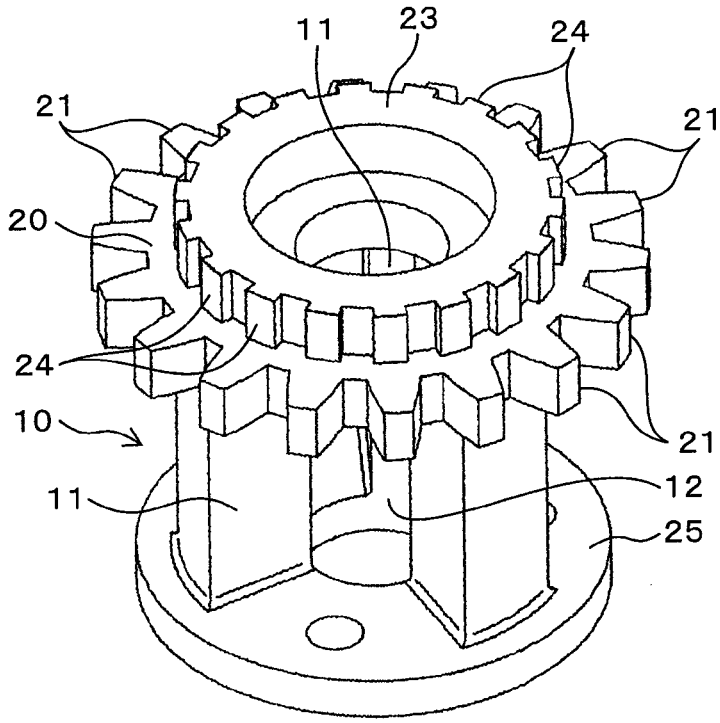
FIG. 1 is a perspective view showing an example of a planetary carrier relating to the present invention.
Figure 2:
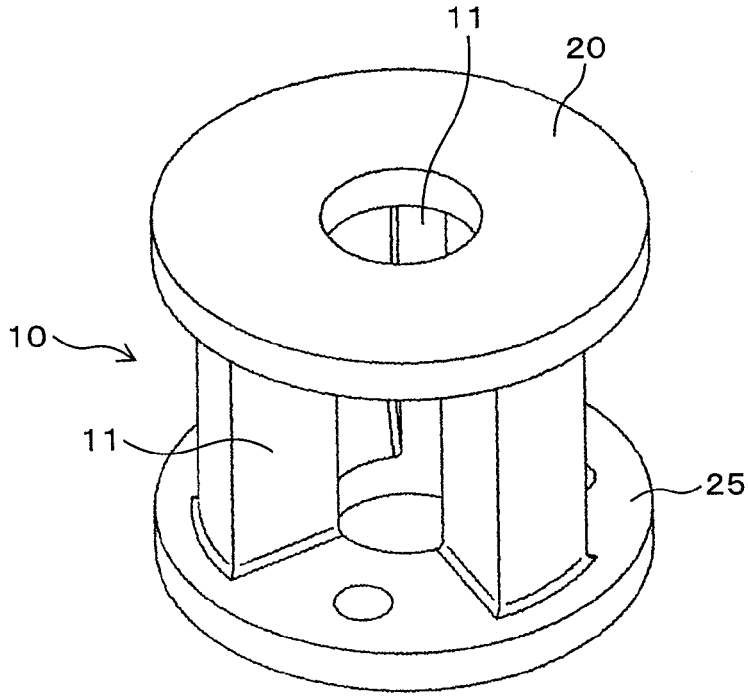
FIG. 2 is a perspective view showing a schematic shape and function of a planetary carrier.
Figure 3A:
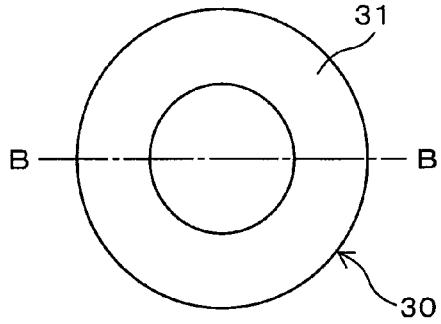
Figure 3B:
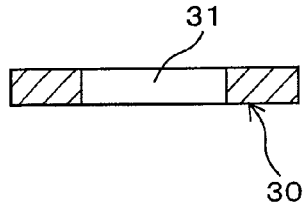
Figure 3C:
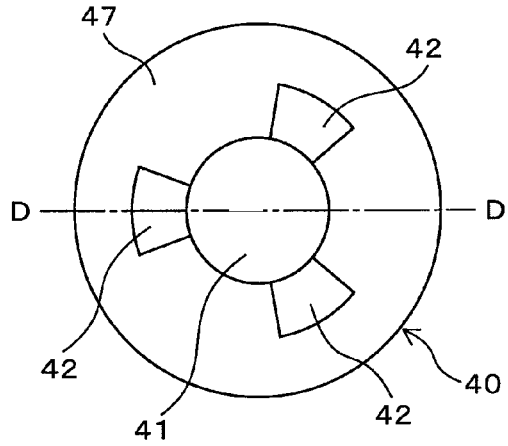
Figure 3D:
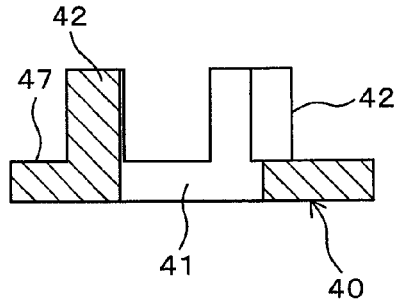
Figure 3E:
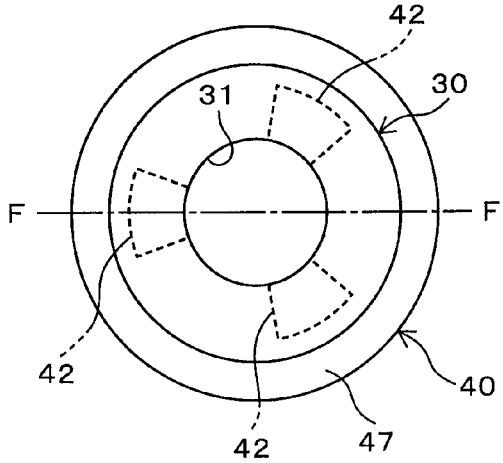
Figure 3F:
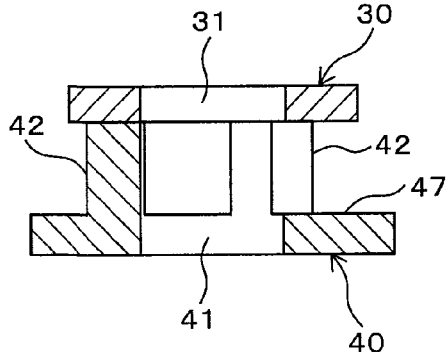
Figure 4A:
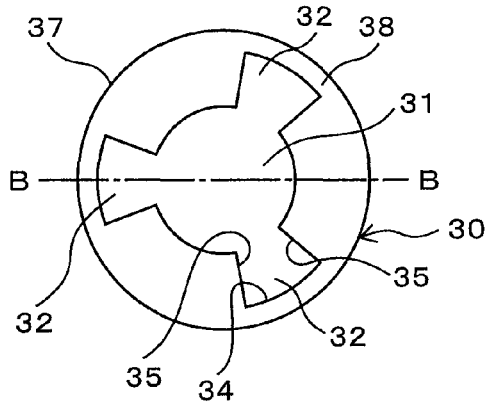
Figure 4B:
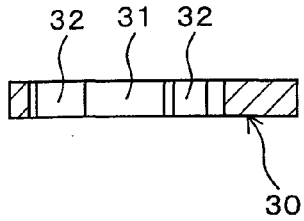
Figure 4C:
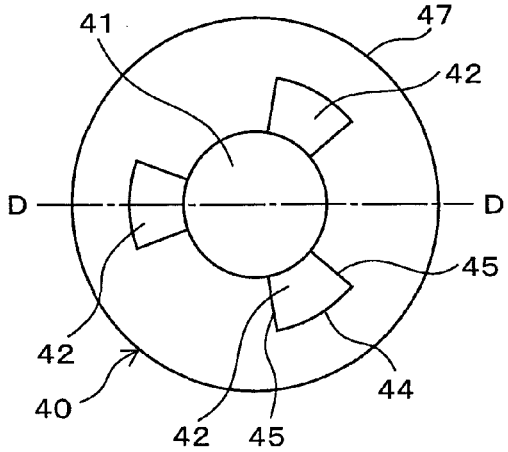
Figure 4D:
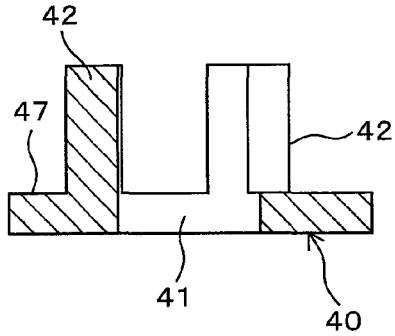
Figure 4E:
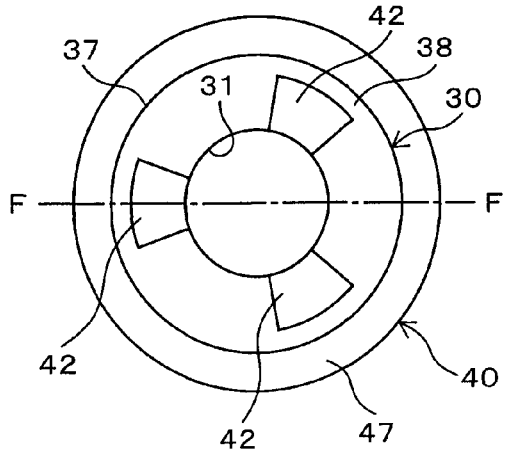
Figure 4F:
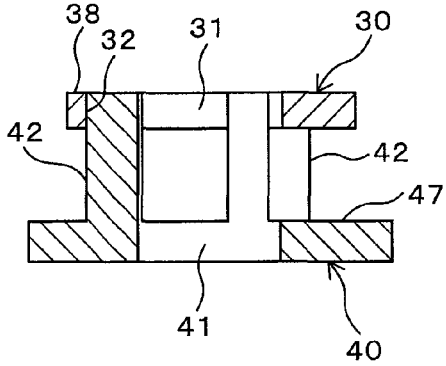
Figure 5A:
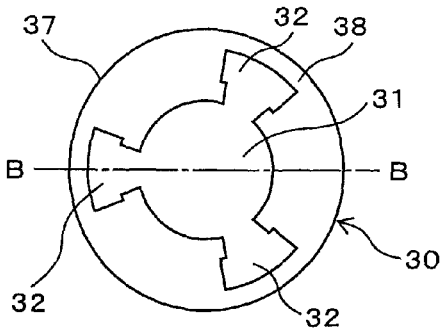
Figure 5B:
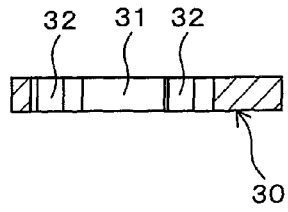
Figure 5C:
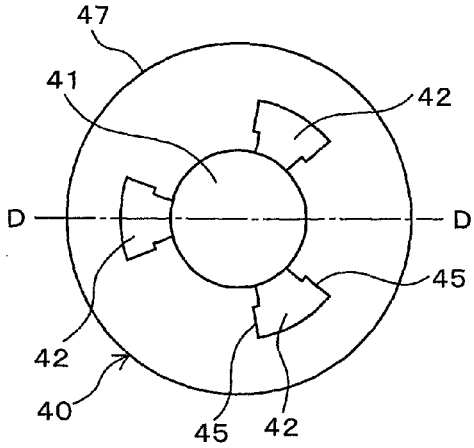
Figure 5D:
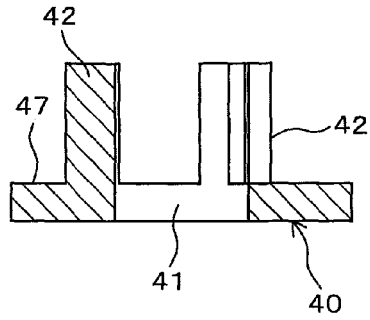
Figure 5E:
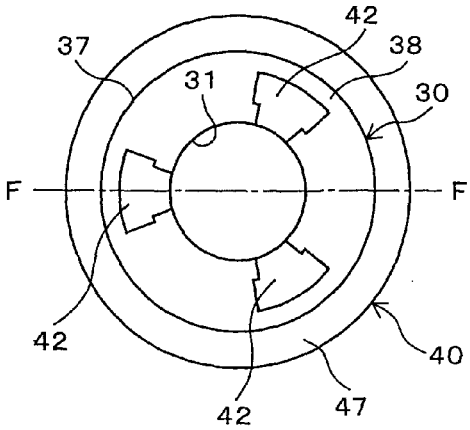
Figure 5F:
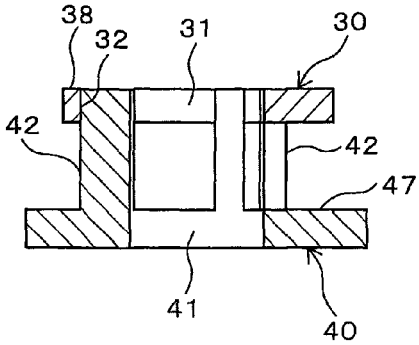

An embodiment of the present invention will be described with reference to the drawings hereinafter.

The embodiment shows a process in which a structure shown in FIGS. 4A to 4F, that is, each hole 32 of a disk-shaped member 30 of a compact, is tightly fitted and bonded with a pillar 42 of a body member 40 of a compact. Then, in a condition in which the disk-shaped member 30 and the body member 40 are tightly fitted, each circumferential side surface 45 facing the circumferential direction of the pillars 42 and each circumferential side surface 35 facing the circumferential direction of the hole 32 are interference fitted at 0 to 0.03 mm of the interference. Thus, the circumferential side surface 45 of the pillars 42 and the circumferential side surface 35 of the holes 32 are tightly contacted in the sintering process, and diffusion of raw powders proceeds at the surfaces of the disk-shaped member 30 and the body member 40, and the disk-shaped member 30 and the body member 40 are thereby bonded.

In the present invention, the compositions of the disk-shaped member 30 and the body member 40 may be selected to differ from each other in amount of thermal expansion in a high temperature range (diffusion temperature range of additive ingredients) during sintering, as disclosed in the patent document 1 to 3. In the present invention, the compositions of the disk-shaped member 30 and the body member 40 are preferable to have compositions in which amounts of thermal expansion are equal. That is, instead of preparing a zinc stearate as a powdered lubricant and another powdered lubricant, and arranging raw powders for the disk-shaped member 30 and the body member 40 respectively as disclosed in the patent document 3, raw powders having the same compositions, which include a powder lubricant, can be used.

Sintering the disk-shaped member 30 and the body member 40 by using raw powders having the same composition produces thermal expansions of the disk-shaped member 30 and the body member 40 respectively. In the embodiment, the holes 32 are press fitted with the pillars 42, whereby the fitting clearance between the disk-shaped member 30 and the body member 40 is not changed in high temperature range during sintering, and diffusion bonding is performed while maintaining a condition in which the boundary of the disk-shaped member 30 and the body member 40 are tightly contacted. When the fitting clearance of the disk-shaped member 30 and the body member 40 may be through fitting (the interference is less than 0 mm), they are insufficiently contacted, and sufficient bonding strength cannot be obtained. On the other hand, when the interference is more than 0.03 mm, the compacts may be broken during press fitting. Therefore, the interference is preferably set to be 0 to 0.03 mm.

When the circumferential side surface 45 of the pillars 42 and the corresponding circumferential side surface 35 of the holes 32 are coincided with the radial line extending in the radial direction, that is, when a center point of plural pillars 42 that are radially arrayed is formed on the extended line of the circumferential side surfaces 45 and 35, a stress occurring during press fitting goes to the radial direction, and the disk-shaped member 30 and the body member 40 are press fitted in a condition in which stiffness of the disk-shaped member 30 is the largest. In this case, most of the stress occurring during press fitting is spend for tightly fitting the disk-shaped member 30 and the body member 40, whereby they are strongly tightly fitted even when the fitting clearance is small. Accordingly, the disk-shaped member 30 and the body member 40 are press fitted in a condition in which the circumferential side surface 45 of the pillars 42 and corresponding circumferential side surface 35 of the holes 32 are coincided with the radial line extending in the radial direction, and the fitting clearance can thereby be minimized.

On the other hand, even when the circumferential side surface 45 of the pillars 42 and the corresponding circumferential side surface 35 of the holes 32 are coincided with the radial line extending in the radial direction, if they are largely inclined with respect to the radial line, the stiffness of the disk-shaped member 30 is decreased at press fitting, whereby the disk-shaped member 30 and the body member 40 are difficult to be brought into sufficient contact. Moreover, in this case, deformation of the disk-shaped member 30 at press fitting is large, and it tends to break. Therefore, the circumferential side surface 45 of the pillars 42 and corresponding circumferential side surface 35 of the hole 32 are required to be in a range −30 to 30° with respect to the radial line (0°). Thus, the circumferential side surface 45 of the pillars 42 and the circumferential side surface 35 of the holes 32 are bonded in the above range with respect to the radial line, whereby a strength with respect to a torsion in rotational direction of a planetary carrier is highly secured.

As described above, the circumferential side surface 45 of the pillars 42 and the circumferential side surface 35 of the hole 32 are bonded with a sufficient bonding strength, whereby a radial side surface 44 of the outer periphery of the pillars 42 and a radial side surface 34 of the hole 32 are bonded with a sufficient strength that is not strong as in the case of the circumferential side surfaces. Accordingly, in the radial side surface 44 of the pillars 42 and the radial side surface 34 of the holes 32, sizes thereof can be selected primarily for prevention of deformation of a thin portion 38 between an outer periphery 37 and the hole 32 of the disk-shaped member 30. Specifically, the disk-shaped member 30 and the body member 40 are interference fitted at not more than 0.01 mm of the interference or are through fitted (interference is minus). In this case, when the interference is more than 0.01 mm, the thin portion 38 tends to break at press fitting. When the compositions of the disk-shaped member 30 and the body member 40 differ in amount of thermal expansion in a high temperature range during sintering as disclosed in the patent documents 1 to 3, it is preferable that the disk-shaped member 30 and the body member 40 be fitted at 0 mm of interference or be through fitted.

The radial side surface 44 of the pillars 42 and the radial side surface 34 of the hole 32 may not be bonded as strongly as in the case of the circumferential side surfaces, and the bonding strength thereof may be improved by bonding. From this point of view, when raw powders having exactly the same composition are used for the disk-shaped member 30 and the body member 40, as described above, the disk-shaped member 30 and the body member 40 are expanded respectively, whereby they can be bonded by preventing deformation of the thin portion 38 even when they are interference fitted at not more than 0.01 mm of interference.

In the manufacturing process of the embodiment, even when the same raw powders are used for the disk-shaped member 30 and the body member 40, the circumferential side surface 45 of the pillars 42 and the corresponding circumferential side surface 35 of the holes 32 can be bonded with sufficient bonding strength, and the radial side surface 44 of the pillars 42 and corresponding radial side surface 34 of the holes 32 can be bonded, preventing deformation of the thin portion 38 between the outer periphery 37 and the hole 32 of the disk-shaped member 30. Moreover, raw powders having the same composition are used for the disk-shaped member 30 and the body member 40, whereby a step for preparing different raw powders for the inner member and the outer member can be omitted, and an error such as an inappropriate composing of raw powders can be avoided.

Figure 6A:
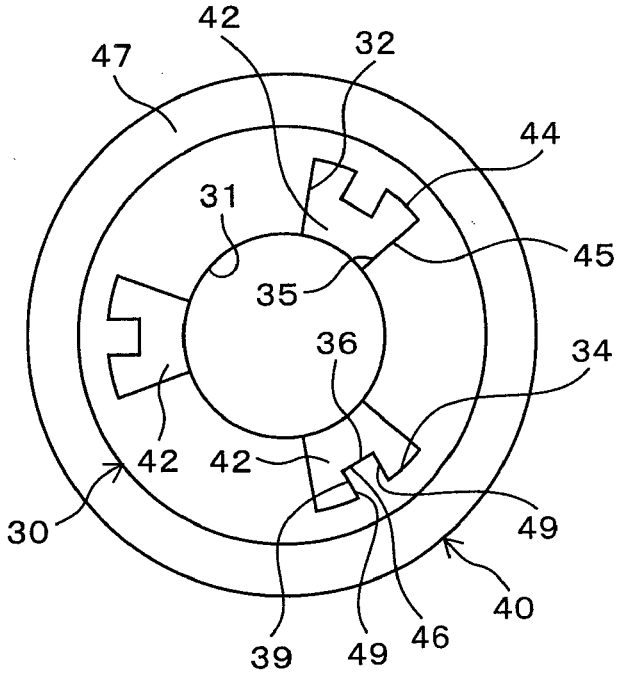
FIGS. 6A and 6B are top views showing other embodiments of components manufactured in the present invention.
Figure 6B:
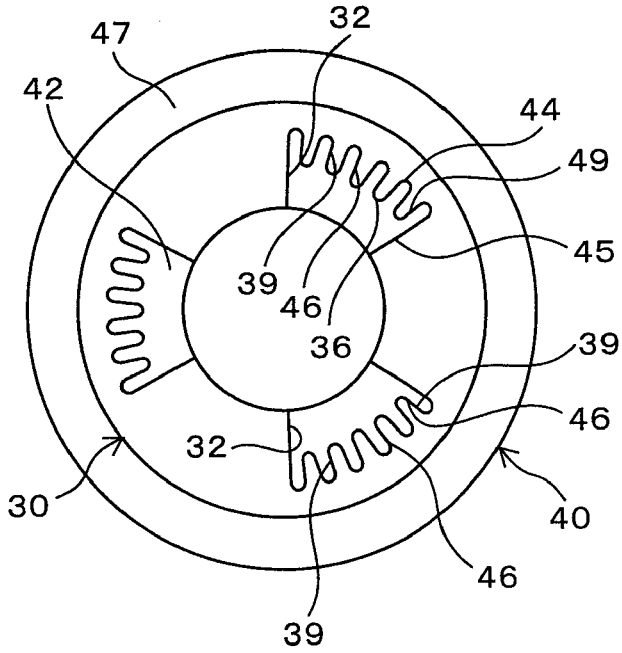

In order to further improve the bonding strength, the length of the bonding surface, that is, the circumferential side surfaces of the holes 32 and the pillars 42, may be elongated. In this case, for example, as shown in FIGS. 6A and 6B, a radial side surface 44 of pillars 42 is formed with one or plural concave portions 46, a hole 32 is formed with a convex portion 36 corresponding to the concave portion 46, and a circumferential side surface 49 of the concave portion 46 and a circumferential side surface 39 of the convex portion 36 are interference fitted at 0 to 0.03 mm of interference and are sintered. Therefore, the length of the bonding surface is increased, and the bonding strength can be further improved.

EMBODIMENTS

Compacts of a body member having the same structure as the body member 40 and a compact of a disk-shaped member having the same structure as the disk-shaped member 30 as shown in FIGS. 4A to 4F were formed by the following processes. In the body member 40, a disk portion 47 was 40 mm in outer diameter, a center shaft hole 41 was 11 mm in diameter, the thickness was 6 mm, and pillars 42 were radially arranged at equal intervals in a standing manner at the periphery of the center shaft hole 41. In the pillar 42, the height was 18 mm, an outer peripheral surface, that is, a radial side surface 44 was 14 mm in radius, an inner peripheral surface was 5.5 mm in radius, and both circumferential side surfaces 45 were fan-shaped in cross section with an open angle of 36°. In the disk-shaped member 30, an outer diameter was 34 mm, a center shaft hole 31 was 11 mm in diameter, the thickness was 6 mm, and three holes 32 that were connected to the center shaft hole 31 and corresponded to the pillars 42 were formed.

When the disk-shaped member 30 and the body member 40 were formed as compacts, a mixed powder in which 0.7% of zinc stearate was added as a powdered lubricant to a powder comprising, by weight, 1.5% of copper powder, 0.7% of graphite, and the balance of iron powder, was compression molded so as to have a compact density of 6.7 g/cm3. In this case, an interference of the circumferential side surface 45 of the pillars 42 and the circumferential side surface 35 of the holes 32 was modified according to the interference shown in Table 1, and plural (sample numbers 01 to 09) compacts were formed. The space between the radial side surface 44 of the pillar 42 and the radial side surface 34 of the hole 32 was set to be 0 mm. Then, the compacts were fitted by press fitting the hole 32 of the disk-shaped member 30 with the pillars 42 of the body member 40, and this was sintered at 1130° C. for 40 minutes in a carburizing denatured butane gas atmosphere so as to bond each other. After the degree of parallelization of the sintered components was investigated, a breaking test was performed in such a way that the body member 40 was held on a mount by a material test machine, and the disk-shaped member 30 was loaded. The bonding strength measured by the test and the degree of parallelization are also shown in Table 1. It should be noted that value (mm) of the degree of parallelization was obtained in such a way that the disk-shaped member 30 of the sintered component was placed with its face down on a flat surface, the distribution of heights of the top surface, which was the bottom surface of the body member 40, was measured, and the lowest value was subtracted from highest value of the height. The lower the value, the greater the degree of parallelization.

TABLE 1

| Sample number | Interference in circumferencial direction mm | Bonding strength kN | Degree of parallelization after bonding mm | Notes |
|---|---|---|---|---|
| 01 | −0.050 | 0.8 | 0.025 | Below lower limit of interference |
| 02 | 0.000 | 2.2 | 0.018 | Lower limit of interference |
| 03 | 0.005 | 8.5 | 0.021 | |

TABLE 1-continued

| Sample number | Interference in circumferencial direction mm | Bonding strength kN | Degree of parallelization after bonding mm | Notes |
|---|---|---|---|---|
| 04 | 0.010 | 13.9 | 0.026 | |
| 05 | 0.015 | 18.1 | 0.025 | |
| 06 | 0.020 | 20.3 | 0.027 | |
| 07 | 0.025 | 20.5 | 0.025 | |
| 08 | 0.030 | 20.5 | 0.028 | Upper limit of interference |
| 09 | 0.035 | 20.2 | 0.032 | Above upper limit of interference. Fractures occurred. |

According to the test results shown in Table 1, in the case of the sample number 01 in which the interference was not more than 0 mm (through fit at 0.05 mm of the space), since the interference is small, the bonding was insufficient, and the bonding strength was low. On the other hand, in the case of the sample number 02 in which the interference was 0 mm, the bonding was sufficient, and the bonding strength was improved. According to the increase of the interference, the bonding strength was improved, but the bonding strength exhibited an approximately constant level when the interference was 0.02 mm or higher. In the case of the sample number 09 in which the interference was more than 0.03 mm, fracturing occurred during press fitting. Since the disk-shaped member and the body member were made from the same raw powder and they were fitted at 0 mm of interference, the degree of parallelization of each sample was good.

What is claimed is:

1. A process for manufacturing composite sintered machine components having an approximately cylindrical inner member and an approximately disk-shaped outer member, the inner member having pillars arranged in a circumferential direction at equal intervals and a center shaft hole surrounded by the pillars, and the outer member having holes corresponding to the pillars of the inner member and a center shaft hole corresponding to the center shaft hole of the inner member and connected to the holes, the process comprising:

compacting the inner member and the outer member individually using an iron-based alloy powder or an iron-based mixed powder so as to obtain compacts of the inner member and the outer member;

tightly fitting the pillars of the inner member into the holes of the outer member; and sintering the inner member and the outer member while maintaining the above condition so as to bond them together;

wherein:

a circumferential side surface facing a circumferential direction of the pillar of the inner member and a circumferential side surface facing a circumferential direction of the hole of the outer member are interference fitted at 0 to 0.03 mm of the interference;

a radial side surface facing a radial direction of the pillar of the inner member and a radial side surface facing a radial direction of the hole of the outer member are fitted so as to be one of being interference fitted at not more than 0.01 mm of the interference and being though fitted;

the circumferential side surface of the pillar of the inner member is formed in a range of −30° to 30° with respect to a radial line extending in the radial direction; and the inner compact and the outer compact have the same compositions.

2. The process for manufacturing composite sintered machine components according to claim 1, wherein the radial side surface of the pillar of the inner member and the radial side surface of the hole of the outer member are fitted so as to be one of being fitted at 0 mm of the interference and being through fitted.

* * * * *